US005624480A

United States Patent [19]

Yoshitake et al.

[11] Patent Number: 5,624,480

[45] Date of Patent: Apr. 29, 1997

[54] COMPOSITION AND PROCESS FOR SUBSTITUTIONALLY PLATING ZINCIFEROUS SURFACES

[75] Inventors: Noriaki Yoshitake; Yoshiyuki Murasawa; Shotaro Tsuda, all of Okayama-ken, Japan

[73] Assignee: Henkel Corporation, Plymouth Meeting, Pa.

[21] Appl. No.: 537,753

[22] PCT Filed: Mar. 28, 1994

[86] PCT No.: PCT/US94/03225

§ 371 Date: Oct. 10, 1995

§ 102(e) Date: Oct. 10, 1995

[87] PCT Pub. No.: WO94/23089

PCT Pub. Date: Oct. 13, 1994

[30] Foreign Application Priority Data

Apr. 7, 1993 [JP] Japan ..... 5-080883

[51] Int. Cl.[6] ..... C23C 22/07

[52] U.S. Cl. ..... 106/1.22; 106/1.12; 106/1.27; 148/259; 148/261; 148/262

[58] Field of Search ..... 106/1.12, 1.22, 106/1.27; 148/259, 261, 262

[56] References Cited

U.S. PATENT DOCUMENTS

| | | | |
|---|---|---|---|
| 3,515,600 | 6/1970 | Jones et al. | 148/6.16 |
| 4,486,233 | 12/1984 | Josso et al. | 106/1.22 |
| 4,636,255 | 1/1987 | Tsuda et al. | 106/1.22 |
| 4,670,066 | 6/1987 | Schapira et al. | 148/6.15 Z |
| 4,776,898 | 10/1988 | Verberne | 148/6.21 |
| 5,185,076 | 2/1993 | Yanada et al. | 106/1.12 |
| 5,258,061 | 11/1993 | Martyak et al. | 106/1.22 |

FOREIGN PATENT DOCUMENTS

| | | |
|---|---|---|
| 022618 | 6/1977 | Japan . |
| 043171 | 10/1977 | Japan . |
| 069978 | 4/1986 | Japan . |
| 049982 | 7/1991 | Japan . |

*Primary Examiner*—Helen Klemanski

*Attorney, Agent, or Firm*—Ernest G. Szoke; Wayne C. Jaeschke; Norvell E. Wisdom, Jr.

[57] ABSTRACT

An acidic substitutional plating bath for zinciferous surfaces, particularly zinciferous metal-plated steel sheet, with which sludge production and equipment corrosion are inhibited and which has an improved heavy metal ion deposition efficiency is provided by an aqueous composition that has a pH of 2 to 4.5 and that contains 1.5 to 40 g/L of at least one heavy metal ion selected from nickel, iron, and cobalt; 0.5 to 10 g/L of phosphate ions; 1 to 250 g/L of sulfate ion; and 1 to 20 g/L of organic acid.

20 Claims, No Drawings

COMPOSITION AND PROCESS FOR SUBSTITUTIONALLY PLATING ZINCIFEROUS SURFACES

TECHNICAL FIELD

The present invention relates to an acidic substitutional plating bath composition, also called a "bath" herein for brevity, for application to zinciferous surfaces, particularly to steel sheet plated with zinc-containing metal (hereinafter referred to as zinciferous metal-plated steel sheet), and to processes for using such a composition to treat metals. More specifically, the present invention relates to an acidic substitutional plating bath composition that can be continuously employed for long periods of time while maintaining its initial performance and that, upon contact with the surface of zinciferous metal-plated steel sheet, forms thereon a heavy metal film that contributes to the formation of a paint undercoat that is very strongly adherent for paint films. This acidic substitutional plating bath composition can also improve the black rust resistance of the unpainted sheet.

As used herein, the term "zinciferous metal-plated steel sheet" encompasses steel sheet plated with zinc or a zinc alloy. Said zinc alloys encompass, for example, zinc-aluminum alloys, zinc-nickel alloys, and zinc-iron alloys.

BACKGROUND ART

In order to increase the adherence of zinciferous metal-plated steel sheet to paint or other types of dryable films coated thereon, treatment of zinciferous metal-plated steel sheet with an acidic aqueous solution (particularly aqueous phosphate solutions) is widely used in industry in order to form a paint undercoat film on the sheet. Paint films laid down on such a phosphate film layer perform well when the treatment has been managed so as to give appropriate film weights and crystal dimensions. Since these physical parameters must be adjusted into appropriate ranges, it therefore becomes necessary to vary the conversion treatment conditions as a function of the type of plating on the steel sheet and the steel sheet line speed and to frequently remove the sludge that is generated in the treatment bath.

In the case of low-lead hot-dip galvanized steel sheet (with a lead content in the zinc plating layer reduced from that in conventional hot-dip galvanized steel sheet), it has already been discovered that corrosion inhibition is obtained due to the absence of lead segregation at the grain boundaries of the crystals in the plating layer and at the interface between the plating layer and alloy layer. Low-lead hot-dip galvanized steel sheet is, as a consequence, widely used in various industrial sectors. However, unlike the conventional hot-dip galvanized steel sheet, low-lead hot-dip galvanized steel sheet resists cracking during bending processes, with the result that shear stresses become concentrated in the phosphate film positioned between the steel sheet and paint film. This produces cohesive failure in the phosphate film, which in turn causes facile delamination of the paint film.

In order to avoid the problems described above, application-type chromate treatments that include hexavalent chromium and trivalent chromium are in use as paint undercoat treatments in place of phosphate treatments. The treatment bath composition in this type of process is easily maintained and managed. Moreover, this type of process can easily respond to many different types of plating and to line speed variations, and the treatment effluent in this case poses few environmental problems. However, the paint adherence of these chromate films is not as good as that of the phosphate films, and in particular delamination of the paint film occurs quite easily during strong flexural working involving pressure contact.

In order to improve the paint adherence of such application-type chromate films, i.e., in order remediate the problem of facile delamination, (1) Japanese Patent Publication Number Sho 43-12974 [12,974/1968], (2) Japanese Patent Publication Number Sho 52-22618 [22,618/1977], (3) Japanese Patent Publication Number Sho 52-43171 [43,171/1977], and (4) Japanese Patent Application Laid Open [Kokai or Unexamined] Number Sho 61-69978 [69,978/1986]propose methods for improving the paint adherence by preliminarily subjecting zinciferous metal-plated steel sheet to heavy metal substitutional plating with Ni, Co, and/or Fe, and so forth, prior to the execution thereon of the chromating treatment.

Considering these previous methods, (1) Japanese Patent Publication Number Sho 43-12974 relates to a method in which zinciferous metal-plated steel sheet is treated with a basic aqueous solution (pH≧11) containing $Co^{2+}$, $Fe^{2+}$, $Fe^{3+}$, or $Ni^{2+}$prior to execution of a chromate treatment on the sheet. However, large amounts of sludge are produced in this method due to the accumulation of the zinc ion eluting into the treatment bath with elapsed treatment time. This necessitates a sludge removal step, which impairs the workability.

(2) Japanese Patent Publication Number Sho 52-22618 and (3) Japanese Patent Publication Number Sho 52-43171 relate to methods in which galvanized steel sheet is treated with an acidic solution (pH around 1.5) that contains $Ni^{2+}$, $Co^{2+}$, $Fe^{2+}$, and/or $Fe^{3+}$prior to execution of a chromate treatment on the sheet. For the purpose of regulating the pH, the acidic substitutional plating baths disclosed in (2) Japanese Patent Publication Number Sho 52-22618 and (3) Japanese Patent Publication Number Sho 52-43171 contain an inorganic acid such as hydrochloric acid, sulfuric acid, hydrofluoric acid, or fluosilicic acid, or an organic acid such as citric acid, acetic acid, oxalic acid, and so forth. The zinc ion eluted into the plating bath is present in dissolved form through the formation of a salt with the inorganic acids or through complex formation with the organic acids. The pH in substitutional plating baths of this type is readily increased by the increase in zinc ion concentration, which results in a decline in the substitutional plating reactions. Due to this, large quantities of inorganic acid must be added in order to maintain the pH of the plating bath at the desired values, and this facilitates corrosion of, for example, stainless steel plating bath tanks, pipes, and so forth. Therefore such baths are quite difficult to implement on a practical basis without the use of a stainless steel reactor and piping both coated with rubber lining or the like. This use of corrosive acid, particularly a volatile one such as hydrochloric acid, also causes a deterioration in the working environment.

Finally, (4) Japanese Patent Application Laid Open Number Sho 61-69978 concerns a method in with low-lead hot-dip galvanized steel sheet is treated with an aqueous alkaline solution that contains Fe, Co, and/or Ni or with an aqueous hydrochloric acid solution, aqueous sulfuric acid solution, or aqueous phosphoric acid solution that contains Fe, Co, and/or Ni. In the case of the aqueous hydrochloric acid solution, aqueous sulfuric acid solution, and aqueous alkaline solution, deposition of these metals is impaired by the increase in Zn ion and increase in pH that occur with elapsed treatment time. On the other hand, in the case of phosphoric acid, it would appear that its pH buffering capacity suppresses the increase in pH, and that substitutional deposition of the Fe, Ni, and/or Co then proceeds smoothly. However, absolutely no explanation of this point can be found in the specification of document (4).

At the same time, chromate treatments have also been applied to zinciferous metal-plated steel sheet for the purpose of improving the corrosion resistance. While this type of treatment very effectively inhibits the development of white rust, black rust (also known as blackening) still occurs during storage and transport. A countermeasure to this problem of post-chromating black rust consists, for example, of flash treatment by Ni, Co, or Fe as disclosed in Japanese Patent Publication Number Hei 3-49982 [49,982/1991].

In the technology described in Japanese Patent Publication Number Hei 3-49982, black rust inhibition is achieved by the pre-chromating treatment of zinciferous metal-plated steel sheet with a treatment bath that has a pH of 1 to 4 or 11 to 13.5 and that contains $Ni^{2+}$ion or $Co^{2+}$ion. Even this method, however, suffers from a reduced workability due to the production of sludge that occurs when the zinc ion concentration becomes elevated during the course of treatment.

DISCLOSURE OF THE INVENTION

Problems to be Solved by the Invention

Thus, the execution prior to chromating of a substitutional plating treatment on the surface of galvanized steel sheet using Ni, Co, and/or Fe, etc., in accordance with the prior art as described above can solve the problem of a poor paint adherence while also accruing the benefit of increasing the black rust resistance of the unpainted sheet. Accordingly, the present invention seeks to introduce a very generally applicable acidic bath composition for the substitutional plating of zinciferous metal-plated steel sheet that is almost free of equipment corrosion and that is capable of a very efficient deposition of heavy metal (e.g., Ni, Co, and/or Fe, etc.) on zinciferous metal-plated steel sheet, with no sludge production with elapsed treatment time, despite the increased zinc ion concentrations in the substitutional plating bath.

SUMMARY OF THE INVENTION

In specific terms, the acidic substitutional plating bath composition of the present invention for application to zinciferous metal-plated steel sheet characteristically has a pH of 2.0 to 4.5 and contains 1.5 to 40 g/L as metal atoms of at least one heavy metal ion selected from nickel, iron, and cobalt; 0.5 to 10 g/L of phosphate ions, including the stoichiometric equivalent as phosphate ions of any undissociated phosphoric acid present in the solution and of all the anions other than phosphate itself produced by any degree of dissociation of phosphoric acid; 1 to 250 g/L of sulfate ions; and 1 to 20 g/L of organic acid.

The inventors have discovered that when phosphoric acid with its high pH buffering capacity is used in the acidic substitutional plating bath in place of the aforesaid inorganic acids, the pH variations are relaxed despite the increases in the zinc ion concentration, and the amount of free inorganic acid ion can therefore be restrained. This makes possible the preparation of an acidic substitutional plating bath that solves the problem with prior acidic substitutional plating baths through its almost complete lack of corrosiveness for stainless steel containers and piping.

In addition, the plating baths disclosed in the prior-art examples referenced above contain compounds of antimony, tin, and so forth, in order to prevent a decline in the substitutional plating reactions at increased levels of zinc ion. With the goal for the present invention of being able to maintain the initial substitutional plating reactions for long periods of time without the addition of such compounds, the present inventors discovered that regulation of the pH to 2.0 to 4.5 and limiting the quantities of etching-active components (phosphate ions, sulfate ions, and organic acid ions) in the treatment bath to within particular ranges avoids the accumulation of large quantities of zinc ion and makes possible use of the plating bath on a continuous basis.

The acidic substitutional plating bath in accordance with the present invention must contain the following components:

First, the bath must contain at least one heavy metal ion selected from nickel, iron, and cobalt. These are advantageously supplied to the plating bath in the form of the corresponding sulfates, phosphates, carbonates, oxides, hydroxides, and organic acid salts. The use of nitrate is undesirable because its presence can lead to the formation of a phosphate film upon zinc dissolution. In addition, long-term use of the chloride runs the risk of chloride ion accumulation and corrosion of the plating equipment.

The plating bath should contain said heavy metal ion(s) at 1.5 to 40 g/L calculated as metal atoms. Metal deposition is inadequate at below 1.5 g/L and a satisfactory effect is therefore not obtained. At above 40 g/L, on the other hand, metal deposition is saturated and the economic losses due to bath carry-out become large.

Orthophosphoric acid is preferably used as the source for the phosphate ion used by the present invention. The content of phosphoric acid in the plating bath should be 0.5 to 10 g/L as phosphate ion. The use of less than 0.5 g/L will result in a sharp increase in bath pH, which influences the component balance. The pH buffering activity is substantially saturated at above 10 g/L, while the amount of zinc etching is increased, with a corresponding decline in deposition efficiency.

Sulfate ions in the present invention are preferably supplied by sulfuric acid. Its content gradually increases because it is generated—by zinc ion capture—in correspondence to the increase in zinc ion. Accordingly, the sulfate ion concentration should be determined by the amount of zinc etching and the amount of plating bath carry-out, but must generally fall in the range of 1 to 250 g/L. Capture of the eluted zinc ion is inadequate at below 1 g/L, while exceeding 250 g/L is economically unattractive because the effect is saturated at such levels.

The organic acid used by the present invention comprises at least one selection from glycolic acid, lactic acid, malic acid, tartaric acid, citric acid, gluconic acid, and ascorbic acid. Preferably, the organic acid is citric or malic acid. The organic acid concentration should be 1 to 20 g/L. Both the ability to capture eluted zinc and the pH buffering capacity are inadequate when the organic acid concentration is less than 1 g/L. On the other hand, the effect becomes saturated when the organic acid concentration exceeds 20 g/L, and these high concentrations also impair the heavy metal deposition efficiency.

An acidic substitutional plating bath in accordance with the present invention containing the ingredients as described above should have a pH adjusted into the range of 2.0 to 4.5. The pH value may be maintained in this range through the supplementary addition of hydrofluoric acid or fluosilicic acid to the plating bath. Zinc oxide or ammonia can be added when the pH is too low. The reasons for the restriction to the pH range of 2.0 to 4.5 are as follows: a pH below 2 signifies an excessive content of inorganic acid, which results in too much zinc etching; equipment corrosion also becomes a risk at lower pH values; at pH values in excess of 4.5 the substitutional plating reactivity is impaired when the amount of eluted zinc ion has become increased.

Acidic substitutional plating may be run by bringing the surface of the zinciferous metal-plated steel sheet into contact with the acidic substitutional plating bath by spraying, immersion, coating, and so forth. Plating is thereby conducted to the desired degree, and is followed by a water wash and drying. The temperature of the plating bath should be room temperature to 80° C., and a treatment time of less than 1 minute will be sufficient. Insofar as concerns the amount of heavy metal deposition, 1 to 100 mg/m$^2$ can provide a desirable performance in the case of paint undercoating treatments, while 0.3 to 20 mg/m$^2$ can provide a desirable black rust prevention in the case of anticorrosion chromate treatments. The desired effects may not appear when the amount of heavy metal does not meet these lower limits, while exceeding the upper limits is economically unattractive because no additional improvement in performance is obtained above the upper limits. Simply driving off the water is sufficient for drying, and the sheet temperature in drying will generally fall in the range of 50° C. to 100° C.

The substitutional plating bath in accordance with the present invention may be applied to the surface of pure zinc, hot-dip galvanization, hot-dip galvanization that contains aluminum or iron as alloying components, and steel sheet electroplated with zinc or zinciferous metal. After this substitutional plating, the zinciferous metal-plated steel sheet is typically subjected to an application-type chromate treatment for the purpose of improving the corrosion resistance, and this is followed by painting. The execution of the subject surface treatment imparts a microscopically etched texture to the surface of the zinciferous metal-plated steel sheet, which has an anchoring effect on the paint film. But in addition, interactions (reciprocal activities) occur between the deposited heavy metal and the post-treatment chromate film, and this has the effect of adsorptively fixing the chromate film on the plated metal surface. The result of these effects is an improvement in adherence between paint films and the underlying zinciferous metal-plated steel sheet. On the other hand, in the case of the execution of a chromate treatment on the zinciferous metal-plated steel sheet after this substitutional plating treatment, the deposited Co, Ni, or Fe functions as a barrier to oxidation reactions, which is thought to inhibit the growth of an oxide film (=black rusting) on the directly underlying plating layer.

The invention may be appreciated in greater detail through consideration of the working examples provided below. These examples are provided in order to aid in using the invention, but in no way restrict the invention.

EXAMPLES

Examples 1 to 3 and Comparison Examples 1 to 4

In each of Examples 1 to 3 and Comparison Examples 1 to 3, the test sheets [as described in General Condition (1) below] were substitutionally plated using a treatment bath with the composition reported in Table 1. The organic acid was citric acid in Examples 1–6 and malic acid in Examples 7–12. The substitutionally plated test sheets and test sheet without substitutional plating (Comparison Example 4) were then cleaned, dried, chromated, and painted in this sequence as described in (3) through (6) below. The painted test sheets were subsequently submitted to flexural testing and corrosion resistance testing as described in (7) and (8) below. Table 2 reports the following values: the substitutional plating conditions, the presence/absence of sludge production and the amount of zinc ion in the bath for treatment bath into which zinc ion has been dissolved by the continuous treatment of test sheets, the amount of heavy metal deposition by substitutional plating, and the results of flexural testing and corrosion resistance testing on the painted sheet.

General Conditions for Examples 1–3 and Comparison Examples 1–4

(1) Test sheet: Hot-dip zinc-plated steel sheet, minimized spangle, unoiled; sheet thickness=0.35 mm, plating weight=90 g/m$^2$.
(2) Substitutional plating treatment: As reported in Table 1.
(3) Cleaning: Spray wash for 10 seconds with tap water.
(4) Drying: Drier used.

TABLE 1

| Example ("E") and Comparison Example ("CE") Numbers | Treatment Composition Characteristics g/L in the Composition of: Zn | Ni | Fe | Co | $PO_4^{-3}$ | $SO_4^{-2}$ | OA | Other | pH |
|---|---|---|---|---|---|---|---|---|---|
| E 1.1 | 0 | — | — | 2.0 | 1.5 | 4 | 1.5 | — | 2.4 |
| E 1.2 | 25 | — | — | 2.0 | 1.5 | 38 | 1.6 | — | 2.4 |
| E 1.3 | 50 | — | — | 2.1 | 1.6 | 79 | 1.6 | — | 2.5 |
| E 2.1 | 5 | 30 | — | — | 4.0 | 49 | 3.0 | ZnO | 3.5 |
| E 2.2 | 25 | 30 | — | — | 4.1 | 81 | 3.0 | — | 3.5 |
| E 2.3 | 50 | 30 | — | — | 4.0 | 122 | 2.9 | — | 3.5 |
| E 3.1 | 2 | — | 6.8 | — | 2.2 | 5 | 9.1 | 0.5 $F^-$ | 2.1 |
| E 3.2 | 15 | — | 6.7 | — | 2.1 | 27 | 9.0 | 0.5 $F^-$ | 2.2 |
| E 3.3 | 30 | — | 7.0 | — | 2.3 | 48 | 9.1 | 0.5 $F^-$ | 2.1 |
| CE 1.1 | 0 | — | — | 2.0 | — | 10 | 1.5 | — | 2.4 |
| CE 1.2 | 5 | — | — | 2.0 | — | 25 | 1.5 | — | 3.8 |
| CE 1.3 | 10 | — | — | 2.0 | — | 50 | 1.6 | — | 4.9 |
| CE 2.1* | 0 | — | 3.7 | 2.4 | — | — | — | — | 13.2 |
| CE 2.2* | 5 | — | 3.7 | 2.5 | — | — | — | — | 13.1 |
| CE 2.3* | 10 | — | 2.8 | 1.6 | — | — | — | — | 13.1 |
| CE 3.1** | 0 | 5.9 | — | — | 48 | 6.5 | — | — | 1.8 |
| CE 3.2** | 5 | 5.9 | — | — | 48 | 7.7 | — | — | 2.0 |

TABLE 1-continued

| Example ("E") and Comparison Example ("CE") Numbers | Treatment Composition Characteristics g/L in the Composition of: Zn | Ni | Fe | Co | $PO_4^{-3}$ | $SO_4^{-2}$ | OA | Other | pH |
|---|---|---|---|---|---|---|---|---|---|
| CE 3.3** | 8 | 5.0 | — | — | 29 | 8.4 | — | — | 2.1 |
| CE 4 | No substitutional plating | | | | | | | | |

Notes for Table 1
"OA" = Organic Acid. In Example 2.1, an amount of zinc oxide sufficient to result in 5 g/L of zinc ions was added at the beginning.
*Example 1 in Japanese Patent Publication Number Sho 43-12974
**Example 2 in Japanese Patent Application Laid Open Number Sho 61-69978

TABLE 2

| Example ("E") and Comparison Example ("CE") Numbers | Sludge Production in the Treatment Bath? | Conditions of Treatment Type | °C. | Sec | AOM, mg/m² | FTR | CTR |
|---|---|---|---|---|---|---|---|
| E 1.1 | no | spray | 65 | 7 | 18 | 5 | NA |
| E 1.2 | no | spray | 65 | 7 | 18 | 5 | NA |
| E 1.3 | no | spray | 65 | 7 | 17 | 5 | NA |
| E 2.1 | no | dip | 50 | 10 | 22 | 5 | NA |
| E 2.2 | no | dip | 50 | 10 | 21 | 5 | NA |
| E 2.3 | no | dip | 50 | 10 | 20 | 5 | NA |
| E 3.1 | no | dip | 45 | 5 | 8 | 5 | NA |
| E 3.2 | no | dip | 45 | 5 | 7 | 4 | NA |
| E 3.3 | no | dip | 45 | 5 | 8 | 5 | NA |
| CE 1.1 | no | spray | 50 | 12 | 8 | 5 | NA |
| CE 1.2 | no | spray | 50 | 12 | 1.0 | 2 | NA |
| CE 1.3 | yes | spray | 50 | 12 | 0.2 | 1 | NA |
| CE 2.1 | no | spray | 70 | 30 | 35 | 5 | 9 F |
| CE 2.2 | no | spray | 70 | 30 | 10 | 4 | 8 M |
| CE 2.3 | yes | spray | 70 | 30 | — | — | — |
| CE 3.1 | no | spray | 50 | 8 | 11 | 4 | NA |
| CE 3.2 | no | spray | 50 | 8 | 0.5 | 1 | 7 M |
| CE 3.3 | yes | spray | 50 | 8 | — | — | — |
| CE 4 | | none | | | — | 1 | NA |

Notes for Table 2
"AOM" = add-on mass of heavy metal achieved by the substitutional plating; "FTR" = flexural test results for painted, treated sheets after a 2 T bend; "CTR" = corrosion resistance test results for painted, treated sheets; "Sec" = seconds of treatment time; "NA" = no abnormalities.

General Conditions Continued (5) Chromate treatment: An application-type chromate bath (aqueous dispersion containing 4% $Cr^{6+}$, 2% $Cr^{3+}$, and 9% $SiO_2$) was roll coated so as to give a chromium add-on of 60 mg/m², followed by drying in a 150° C. hot-air drying oven at a maximum attained sheet temperature of 60° C.

(6) Painting: A back-surface alkyd paint was applied by bar coating so as to yield a dry paint film thickness of 6 micrometers. This was followed by drying in a 300° C. hot-air drying oven at a maximum attained sheet temperature of 210° C.

(7) Flexural testing of the painted sheet: In accordance with "Test Methods for Colored Galvanized Steel Sheet" of JIS G 3312, a 2T bending test was run on each test sheet at 20° C. using 2 inside bending spacer sheets. The extent of delamination after tape peeling was evaluated on the following scale: 5: no abnormalities; 4: only cracking or delaminated area less than 5%; 3: delaminated area from 5% to less than 25%; 2: delaminated area from 25% to less than 50%; 1: delaminated area at least 50%.

(8) Corrosion resistance testing of the painted sheet: A 70×150 mm coupon was cut from each test sheet and subjected to the salt-spray test stipulated in JIS Z 2371 for 500 hours. Blistering on the surface of the painted coupon was then evaluated according to the criteria of the American Society for Testing and Materials (ASTM).

With reference to the results reported in Tables 1 and 2, due to the pH increase in correspondence to the increase in eluted zinc ion in Comparison Example 1 (substitution plating bath without phosphate ion), the amount of heavy metal deposition declined and the flexural adherence of the painted sheet decreased as a result. In Comparison Examples 2 and 3, sludge was produced by the increase in quantity of zinc ion elution. In Comparison Example 4 (no substitutional plating), the painted sheet evidenced a poor adherence. In contrast to these results, in Examples 1 to 3 in accordance with the invention, no sludge was produced even at increased quantities of eluted zinc ion and it was possible to maintain the initial performance for long periods of time.

Examples 4 to 6 and Comparison Examples 5 to 8

In Examples 4 to 6 and Comparison Examples 5 and 6, test sheets as reported in (1) below were subjected to substitutional plating treatments using the treatment bath compositions reported in Table 3. The substitutionally plated test sheets and test sheet without substitutional plating (Comparison Example 8) were then cleaned, dried, chromated, and painted in this sequence as described in (3) through (6) below. In Comparison Example 7 the test sheet was treated with zinc phosphate and then painted. The painted test sheets were subsequently submitted to flexural testing and edge creepage testing as described in (7) and (8) below. Table 4 reports the following values: the substitutional plating conditions, the presence/absence of sludge production and the amount of zinc ion in the bath for treatment bath into which zinc ion has been dissolved by the continuous treatment of test sheet, the amount of heavy metal deposition by substitutional plating, and the results of flexural testing and edge creepage testing on the painted sheet.

General Condition for Examples 4–6 and Comparison Examples 5–8

(1) Test sheet: Ultra-low-lead hot-dip zinc-plated steel sheet (Pb content in plating bath=0.003%), unoiled; sheet thickness=0.4 mm, plating mass=125 g/m².

(2) Substitutional plating or other treatment: See Table 3.

(3) Cleaning: Spray wash for 10 seconds with tap water.

(4) Drying: Drier used.

(5) Chromate treatment: An application-type chromate bath (aqueous dispersion containing 3% $Cr^{6+}$, 2% $Cr^{3+}$, 7% SiO2, and 0.5% resin) was roll coated so as to give a chromium add-on of 70 mg/m$^2$, followed by drying in a 150° C. hot-air drying oven at a maximum attained sheet temperature of 60° C.

(6) Painting: An epoxy primer was applied by bar coating so as to yield a dry paint film thickness of 5 micrometers followed by baking in a 300° C. hot-air drying oven at a maximum attained sheet temperature of 195° C. A polyester top coat was applied so as to yield a dry paint film thickness of 12 micrometers, followed by baking in a 300° C. hot-air drying oven at a maximum attained sheet temperature of 220° C.

TABLE 3

| Example ("E") and Comparison Example ("CE") Numbers | Treatment Composition Characteristics g/L in the Composition of: Zn | Ni | Fe | Co | $PO_4^{-3}$ | $SO_4^{-2}$ | OA | Other | pH |
|---|---|---|---|---|---|---|---|---|---|
| E 4.1 | 0 | 4.5 | — | 2.0 | 5.1 | 11 | 2.9 | — | 2.8 |
| E 4.2 | 25 | 4.5 | — | 2.1 | 5.2 | 43 | 2.8 | — | 2.9 |
| E 4.3 | 50 | 4.6 | — | 2.1 | 5.1 | 70 | 2.9 | — | 3.0 |
| E 5.1 | 5 | — | 35 | — | 0.8 | 63 | 1.3 | 1.6 $F^-$ | 2.4 |
| E 5.2 | 50 | — | 35 | — | 0.8 | 140 | 1.4 | 1.6 $F^-$ | 2.4 |
| E 5.3 | 100 | — | 35 | — | 0.8 | 210 | 1.4 | 1.5 $F^-$ | 2.4 |
| E 6.1 | 0 | 9.9 | — | — | 8.6 | 2 | 8 | $NH_3$ | 3.8 |
| E 6.2 | 25 | 9.9 | — | — | 8.7 | 38 | 8 | — | 3.9 |
| E 6.3 | 50 | 10.0 | — | — | 8.7 | 82 | 9 | — | 4.0 |
| CE 5.1 | 0 | 4.5 | — | 2.0 | 5.1 | 1.9 | 10 | 9.4 $NO_3^-$ | 2.6 |
| CE 5.2 | 5 | 4.5 | — | 2.0 | 5.1 | 2.0 | 9 | 9.9 $NO_3^-$ | 2.5 |
| CE 6.1 | 0 | — | 35 | — | 11 | 60 | 10.0 | 1.6 $F^-$ | 1.4 |
| CE 6.2 | 50 | — | 34 | — | 11 | 63 | 9.9 | 1.6 $F^-$ | 1.6 |
| CE 6.3 | 100 | — | 34 | — | 12 | 68 | 10.1 | 1.7 $F^-$ | 1.8 |
| CE 7 | Zinc phosphate conversion coating of 1 g/m$^2$ | | | | | | | | |
| CE 8 | No substitutional plating or other coating before painting | | | | | | | | |

Note for Table 3
"OA" = Organic Acid.

TABLE 4

| Example ("E") and Comparison Example ("CE") Numbers | Sludge Production in the Treatment Bath? | Conditions of Treatment Type | °C. | Sec | AOM, mg/m$^2$ | FTR | ECT mm |
|---|---|---|---|---|---|---|---|
| E 4.1 | no | dip | 55 | 10 | 35 | 5 | 5 |
| E 4.2 | no | dip | 55 | 10 | 33 | 5 | 6 |
| E 4.3 | no | dip | 55 | 10 | 33 | 5 | 5 |
| E 5.1 | no | dip | 75 | 5 | 65 | 5 | 5 |
| E 5.2 | no | dip | 75 | 5 | 65 | 5 | 5 |
| E 5.3 | no | dip | 75 | 5 | 64 | 5 | 5 |
| E 6.1 | no | spray | 60 | 8 | 29 | 5 | 6 |
| E 6.2 | no | spray | 60 | 8 | 28 | 5 | 6 |
| E 6.3 | no | spray | 60 | 8 | 29 | 4 | 7 |
| CE 5.1 | no | dip | 45 | 8 | 19 | 5 | 7 |
| CE 5.2 | no | dip | 45 | 8 | 15* | 2 | 5 |
| CE 6.1 | no | spray | 50 | 10 | 24 | 5 | 6 |
| CE 6.2 | no | spray | 50 | 10 | 4 | 4 | 9 |
| CE 6.3 | yes | spray | 50 | 10 | 0.2 | 1 | 16 |

TABLE 4-continued

| Example ("E") and Comparison Example ("CE") Numbers | Sludge Production in the Treatment Bath? | Conditions of Treatment Type | °C. | Sec | AOM, mg/m$^2$ | FTR | ECT mm |
|---|---|---|---|---|---|---|---|
| CE 7 | not applicable | | | | — | 1 | 5 |
| CE 8 | none | | | | — | 1 | 20 |

Notes for Table 4
"AOM" = add-on mass of heavy metal achieved by the substitutional plating; "Sec" = seconds of treatment time; "FTR" = flexural test results for painted, treated sheets after a 2 T bend; "ECT" = edge creepage results for painted, treated sheets.

General Condition Continued (7) Flexural testing of the painted sheet: In accordance with "Test Methods for Colored Galvanized Steel Sheet" of JIS G 3312, a 1T bending test was run on each test sheet at 20° C. using 1 inside bending spacer sheet. The extent of delamination after tape peeling was evaluated on the same scale as for Examples 1–3.

(8) Edge creepage test on the painted sheet: 70×150 mm coupons were cut from the test sheets in such a way that fins projected out at the top and bottom on both ends. After 1000 hours of salt-spray testing in accordance with JIS Z 2371, the maximum creepage widths (mm) from the edges were measured on both sides. The average value is reported.

With reference to the results reported in Tables 3 and 4, the painted sheet evidenced a poor adherence in Comparison Examples 5 and 7 in which a zinc phosphate coating was formed on ultra-low-lead hot-dip zinc-plated steel sheet. In Comparison Example 6 (low pH), the increase in the amount of eluted zinc ion caused a corresponding decline in substitutional deposition of the heavy metal as well as the production of sludge. The flexural adherence of the painted sheet and the edge creepage of the painted sheet were poor in Comparison Example 8 (no substitutional plating treatment). In contrast to these results, a phosphate film was not produced in Examples 4 to 6 of the invention even in the face of zinc ion elution and it was possible to maintain the initial performance for long periods of time.

Examples 7 to 9 and Comparison Examples 9 to 11

In Examples 7 to 9 and Comparison Examples 9 and 10, test sheets as reported in (1) below were subjected to substitutional plating treatments using the treatment bath compositions reported in Table 5. The substitutionally plated test sheets and test sheet without substitutional plating (Comparison Example 11) were then degreased, cleaned, dried, chromated, and painted in this sequence as described in (2) through (9) below. The thus-treated test sheets were subsequently submitted to adherence testing on the painted sheet and corrosion resistance testing on the painted sheet as described in (10) and (11) below. Table 6 reports the following values: the substitutional plating conditions, the presence/absence of sludge production and the amount of zinc ion in the bath for treatment bath into

TABLE 5

| Example ("E") and Comparison Example ("CE") Numbers | Treatment Composition Characteristics g/L in the Composition of: Zn | Ni | Fe | Co | $PO_4^{-3}$ | $SO_4^{-2}$ | OA | Other | pH |
|---|---|---|---|---|---|---|---|---|---|
| E 7.1 | 0 | — | 1.0 | 1.4 | 2.9 | 19 | 4.9 | — | 3.0 |
| E 7.2 | 25 | — | 1.0 | 1.4 | 2.8 | 37 | 5.0 | — | 3.1 |
| E 7.3 | 50 | — | 0.9 | 1.4 | 2.8 | 73 | 5.0 | — | 3.0 |
| E 8.1 | 0 | 3.1 | — | — | 5.1 | 5 | 3.5 | — | 2.5 |
| E 8.2 | 25 | 3.1 | — | — | 5.0 | 32 | 3.5 | — | 2.5 |
| E 8.3 | 50 | 3.2 | — | — | 5.2 | 69 | 3.5 | — | 2.5 |
| E 9.1 | 5 | 35 | — | — | 4.7 | 64 | 2.1 | 1.8 $F^-$ | 4.2 |
| E 9.2 | 50 | 35 | — | — | 4.6 | 101 | 2.0 | 1.8 $F^-$ | 4.2 |
| E 9.3 | 100 | 35 | — | — | 4.5 | 145 | 2.0 | 1.7 $F^-$ | 4.3 |
| CE 9.1 | 0 | — | 1.0 | 1.4 | 2.9 | 19 | — | — | 3.3 |
| CE 9.2 | 10 | — | 1.0 | 1.4 | 2.9 | 27 | — | — | 3.9 |
| CE 9.3 | 25 | — | 1.0 | 1.4 | 2.8 | 35 | — | — | 5.0 |
| CE 10.1 | 0 | — | 0.8 | 0.4 | 2.9 | 19 | 4 | — | 3.0 |
| CE 10.2 | 5 | — | 0.8 | 0.4 | 2.9 | 22 | 4 | — | 3.0 |
| CE 11 | No substitutional plating or other coating before painting | | | | | | | | |

Note for Table 5
"OA" = Organic Acid.

TABLE 6

| Example ("E") and Comparison Example ("CE") Numbers | Sludge Production In the Treatment Bath? | Conditions of Treatment Type | °C. | Sec | AOM, mg/m² | Adherence Test Results CT | ET | mm CR |
|---|---|---|---|---|---|---|---|---|
| E 7.1 | no | spray | 70 | 8 | 25 | 4 | 4 | 0.2 |
| E 7.2 | no | spray | 70 | 8 | 24 | 4 | 3 | 0.2 |
| E 7.3 | no | spray | 70 | 8 | 24 | 4 | 4 | 0.2 |
| E 8.1 | no | dip | 70 | 10 | 34 | 4 | 4 | 0.2 |
| E 8.2 | no | dip | 70 | 10 | 36 | 4 | 4 | 0.2 |
| E 8.3 | no | dip | 70 | 10 | 35 | 4 | 3 | 0.2 |
| E 9.1 | no | spray | 60 | 5 | 14 | 4 | 4 | 0.5 |
| E 9.2 | no | spray | 60 | 5 | 15 | 4 | 4 | 0.2 |
| E 9.3 | no | spray | 60 | 5 | 15 | 4 | 4 | 0.5 |
| CE 9.1 | no | spray | 60 | 10 | 17 | 4 | 3 | 0.2 |
| CE 9.2 | no | spray | 60 | 10 | 7 | 4 | 3 | 0.2 |
| CE 9.3 | yes | spray | 60 | 10 | 0.2 | 2 | 1 | 1.0 |
| CE 10.1 | no | spray | 70 | 30 | 10 | 4 | 4 | 0.2 |

TABLE 6-continued

| Example ("E") and Comparison Example ("CE") | Sludge Production In the Treatment | Conditions of Treatment | | | AOM, | Adherence Test Results | | mm |
|---|---|---|---|---|---|---|---|---|
| Numbers | Bath? | Type | °C. | Sec | mg/m² | CT | ET | CR |
| CE 10.2 | no | spray | 70 | 30 | 0.5 | 2 | 2 | 1.0 |
| CE 11 | | none | | | — | 1 | 1 | 1.5 |

Notes for Table 6
"Sec" = seconds of treatment time; "AOM" = add-on mass of heavy metal achieved by the substitutional plating; "CR" = corrosion resistance results for painted, treated sheets; "CT" = checkerboard test; "ET" = Erichsen test.

which zinc ion has been dissolved by the continuous treatment of test sheet, the amount of heavy metal deposition by substitutional plating, and the results of adherence testing and corrosion resistance testing on the painted sheet.

General Conditions for Examples 7–9 and Comparison Examples 9–11

(1) Test sheet: Electrogalvanized steel sheet, oiled, sheet thickness=0.8 mm, plating mass=20 g/m².
(2) Degreasing: 30 second spray at 60° C. with a 2% aqueous solution of an alkaline degreaser (PALKLIN™ N364S from Nihon Parkerizing Company, Limited).
(3) Cleaning: 10 second spray with tap water.
(4) Roll squeegee.
(5) Substitutional plating treatment: As reported in Table 5.
(6) Cleaning: 10 second spray with tap water.
(7) Drying: Drier used.
(8) Chromate treatment: An application-type chromate bath (aqueous dispersion containing 2% $Cr^{6+}$ and 1% $Cr^{3+}$) was roll coated so as to give a chromium add-on of 50 mg/m², followed by drying in a 250° C. hot-air drying oven at a maximum attained sheet temperature of 150° C.
(9) Painting: A bakable melamine-alkyd paint was applied by bar coating so as to yield a dry paint film thickness of 25 micrometers followed by baking at a sheet temperature of 140° C. for 20 minutes.
(10) Adherence testing of the painted sheet: 1. Checkerboard test: Using a cutter, a grid of 1 mm×1 mm squares was cut into the test sheet to the basis metal; the extent of peeling of the paint film was evaluated after peeling with tape; 2. Erichsen test: A 6 mm extrusion was performed on the test sheet using an Erichsen extruder; the extent of peeling of the paint film was evaluated after peeling with tape; in the preceding two items, the paint film adherence was evaluated on the following four level scale based on the extent of peeling of the paint film: 4:0% paint film peeling; 3: less than 10% paint film peeling; 2: from 10% to less than 30% paint film peeling; 1: at least 30% paint film peeling.
(11) Corrosion resistance of the painted sheet: A 70×150 mm coupon was cut from the test sheet, and a scribe line was made in the paint film down to the basis metal using a cutter. After 200 hours of salt-spray testing, a tape peel was carried out, and the maximum single-side peel width (mm) from the scribe line was measured.

With reference to the results reported in Tables 5 and 6, as the quantity of eluted zinc ion increased in Comparison Example 9 (no addition of organic acid), the amount of heavy metal deposition declined due to the pH increase and sludge was also produced. In Comparison Example 10 (low heavy metal ion concentration), the amount of heavy metal deposition declined as the amount of zinc ion increased, and the adherence by the painted sheet declined as a result. In Comparison Example 11 (no substitutional plating treatment), the painted sheet evidenced a poor adherence and corrosion resistance. In contrast to these results, in Examples 7 to 9 in accordance with the invention, the initial performance was maintained in the long-term and the painted sheet obtained had excellent properties.

Examples 10 to 12 and Comparison Examples 12 to 14

In Examples 10 to 12 and Comparison Examples 12 and 13, test sheets as reported in (1) below were subjected to substitutional plating treatments using the treatment bath compositions reported in Table 7. The substitutionally plated test sheets and test sheet without substitutional plating (Comparison Example 14) were then cleaned, dried, and chromated in this sequence as described in (3) through (5) below. The thus-treated test sheets were subsequently submitted to accelerated white rust testing and accelerated black rust testing as described in (6) and (7) below. Table 8 reports the following values: the substitutional plating conditions, the presence/absence of sludge production and the amount of zinc ion in the bath for treatment bath into which zinc ion has been dissolved by the continuous treatment of test sheet, the amount of heavy metal deposition by substitutional plating, and the results of accelerated white rust testing and accelerated black rust testing.

General Conditions for Examples 10–12 and Comparison Examples 12–14

(1) Test sheets: Steel sheet plated with Zn/5% Al alloy, sheet thickness=0.7 mm, plating mass=90 g/m².
(2) Substitutional plating treatment: As reported in Table 7.

TABLE 7

| Example ("E") and Comparison Example ("CE") Numbers | Treatment Composition Characteristics g/L in the Composition of: Zn | Ni | Fe | Co | $PO_4^{-3}$ | $SO_4^{-2}$ | OA | Other | pH |
|---|---|---|---|---|---|---|---|---|---|
| E 10.1 | 2 | 0.8 | 1.0 | — | 1.0 | 3 | 1.2 | $ZnCO_3$ | 4.0 |
| E 10.2 | 10 | 0.9 | 1.0 | — | 0.9 | 15 | 1.2 | | 4.1 |
| E 10.3 | 25 | 0.8 | 1.0 | — | 0.9 | 38 | 1.2 | | 4.0 |
| E 11.1 | 5 | 3.0 | — | — | 4.0 | 9 | 3.0 | | 3.2 |
| E 11.2 | 25 | 3.0 | — | — | 4.1 | 41 | 3.0 | | 3.2 |
| E 11.3 | 50 | 3.0 | — | — | 4.0 | 75 | 2.9 | | 3.2 |
| E 12.1 | 2 | — | — | 16 | 2.5 | 5 | 9.1 | $NH_3$ | 2.8 |
| E 12.2 | 15 | — | — | 16 | 2.6 | 27 | 9.0 | | 2.7 |
| E 12.3 | 30 | — | — | 16 | 2.6 | 48 | 9.1 | | 2.8 |
| CE 12.1* | 0 | 11 | — | — | — | 19 | — | | 2.0 |
| CE 12.2* | 5 | 10 | — | — | — | 30 | — | | 1.5 |
| CE 12.3* | 10 | 10 | — | — | — | 52 | — | | 1.0 |
| CE 13.1** | 0 | — | — | 11 | — | 17 | 15 | | 13.2 |
| CE 13.2** | 5 | — | — | 11 | — | 18 | 15 | | 13.1 |
| CE 13.3** | 10 | — | — | 9 | — | 18 | 15 | | 13.1 |
| CE 14 | No substitutional plating | | | | | | | | |

Notes for Table 1
"OA" = Organic Acid.
*Example 1-(b) in Japanese Patent Publication Number Hei 3-49982
**Example 1-(d) in Japanese Patent Publication Number Hei 349982

TABLE 8

| Example ("E") and Comparison Example ("CE") Numbers | Sludge Production In the Treatment Bath? | Conditions of Treatment Type | °C. | Sec | AOM, mg/m² | RWR | RBR |
|---|---|---|---|---|---|---|---|
| E 10.1 | no | spray | 45 | 3 | 1.7 | 5 | 5 |
| E 10.2 | no | spray | 45 | 3 | 1.6 | 5 | 5 |
| E 10.3 | no | spray | 45 | 3 | 1.5 | 5 | 5 |
| E 11.1 | no | dip | 60 | 5 | 2.5 | 5 | 5 |
| E 11.2 | no | dip | 60 | 5 | 2.5 | 5 | 5 |
| E 11.3 | no | dip | 60 | 5 | 2.4 | 5 | 5 |
| E 12.1 | no | dip | 50 | 5 | 2.9 | 5 | 5 |
| E 12.2 | no | dip | 50 | 5 | 2.8 | 5 | 5 |
| E 12.3 | no | dip | 50 | 5 | 2.9 | 5 | 5 |
| CE 12.1 | no | dip | 50 | 10 | 23.9 | 1 | 5 |
| CE 12.2 | no | dip | 50 | 10 | 5.0 | 4 | 5 |
| CE 12.3 | no | dip | 50 | 10 | 0.1 | 5 | 2 |
| CE 13.1 | no | dip | 60 | 2 | 2.4 | 5 | 5 |
| CE 13.2 | no | dip | 60 | 2 | 2.4 | 5 | 5 |
| CE 13.3 | yes | dip | 60 | 2 | 2.2 | 5 | 5 |
| CE 14 | | none | | | — | 5 | 1 |

Notes for Table 8
"AOM" = add-on mass of heavy metal achieved by the substitutional plating; "RWR" = resistance to white rusting test results for painted, treated sheets; "RBR" = resistance to black rusting test results for painted, treated sheets; "Sec" = seconds of treatment time.

General Conditions Continued (3) Cleaning: 10 second spray with tap water.
(4) Drying: Drier used.
(5) chromate treatment: An application-type chromate bath (4% $Cr^{6+}$and 2% $Cr^{3+}$)was roll coated so as to give a chromium add-on of 25 mg/m², followed by drying in a 150° C. hot-air drying oven at a maximum attained sheet temperature of 60° C.
(6) Accelerated white rust testing: A 70×150 mm test coupon was cut from the test sheet and subjected to salt-spray testing in accordance with JIS Z 2371. The area of white rust development was visually rated after 72 hours using the following criteria: 5: no white rust; 4: area of white rust development less than 5%; 3: area of white rust development from 5% to less than 25%; 2: area of white rust development from 25% to less than 50%; 1: area of white rust development is at least 50%.
(7) Accelerated black rust testing: A multiple number of 70×150 mm coupons were cut from the test sheet. Pairs were prepared by placing the test surfaces of the coupons against one another, and these pairs were stacked. The entire assembly was wrapped with vinyl-coated paper, and the four corners of the assembly were tightened down with bolts. A load of 1 kgf/cm² was applied using a torque wrench. The assembly was held for 240 hours in a humidifying tester at 49° C. and 98% relative humidity and subsequently withdrawn. Blackening of the overlaid regions was then visually rated using the following criteria: 5: no blackening; 4: very slight greying; 3: less than 25% blackening; 2: blackening from 25% to less than 50%; 1: blackening at least 50%.

With reference to the results in Tables 7 and 8, there was a large initial heavy metal deposition in Comparison Example 12 (absence of phosphate ion and organic acid) and the white rust resistance was therefore poor. Subsequent to this, the heavy metal deposition declined—and the black rust resistance therefore declined—due to the drop in pH as the eluted zinc ion increased. In Comparison Example 13, sludge was produced by the increase in quantity of eluted zinc ion. The black rust resistance was poor in Comparison Example 14 (no substitutional plating treatment). In contrast to this, in Examples 10 to 12 in accordance with the invention, sludge production did not occur despite the increase in amount of eluted zinc ion and it was possible to maintain the initial performance for the long-term.

Benefits of the Invention

In application as a paint undercoating treatment, the acidic substitutional plating bath composition of the invention for zinciferous metal-plated steel sheet imparts an excellent adherence and corrosion resistance to the painted sheet. In application as an undercoating treatment for chromating, this composition yields an excellent black rust resistance. Moreover, the acidic substitutional plating bath composition of the invention retains its initial performance for long periods of time and can therefore be used on a continuous basis. Finally, it is almost completely free of corrosiveness for equipment. As a result of these attributes, the invention composition has substantial industrial usefulness.

The invention claimed is:

1. An aqueous substitutional plating bath composition having a pH of 2.0 to 4.5 and containing water and:

(A) from 1.5 to 40 g/L as metal atom of heavy metal ions selected from the group consisting of nickel, iron, cobalt, and mixtures of any two or more thereof;

(B) from 0.5 to 10 g/L of phosphate ions;

(C) from 1 to 250 g/L of sulfate ions; and (D) from 1 to 20 g/L of organic acid.

2. An aqueous composition in accordance with claim 1 in which the organic acid is selected from the group consisting of glycolic acid, lactic acid, malic acid, tartaric acid, citric acid, gluconic acid, ascorbic acid, and mixtures of any two or more thereof.

3. An aqueous composition in accordance with claim 2 comprising at least one of hydrofluoric acid, fluosilicic acid, zinc oxide, or ammonia.

4. An aqueous composition in accordance with claim 1 comprising at least one of hydrofluoric acid, fluosilicic acid, zinc oxide, or ammonia.

5. A process comprising steps of contacting a zinciferous surface with a composition according to claim 4 for a time sufficient to deposit on the zinciferous surface at least 0.3 mg of heavy metal per square meter of zinciferous surface contacted, removing the zinciferous surface from contact with the aqueous composition according to claim 4, washing the coating of heavy metal on the zinciferous surface with water, and drying the zinciferous surface.

6. A process according to claim 5, wherein the amount of heavy metal deposited on the zinciferous surface is from 1 to 100 mg/m$^2$ and the dried zinciferous surface is subsequently painted.

7. A process according to claim 5, wherein the amount of heavy metal deposited on the zinciferous surface is from 0.3 to 20 mg/m$^2$, and the dried zinciferous surface is subsequently subjected to an anticorrosion chromate treatment.

8. A process according to claim 7, wherein the zinciferous surface is that of zinciferous metal plated steel sheet.

9. A process according to claim 5, wherein the zinciferous surface is that of zinciferous metal plated steel sheet.

10. A process comprising steps of contacting a zinciferous surface with a composition according to claim 3 for a time sufficient to deposit on the zinciferous surface at least 0.3 mg of heavy metal per square meter of zinciferous surface contacted, removing the zinciferous surface from contact with the aqueous composition according to claim 3, washing the coating of heavy metal on the zinciferous suffice with water, and drying the zinciferous surface.

11. A process according to claim 11, wherein the amount of heavy metal deposited on the zincifirous surface is from 1 to 100 mg/m$^2$ and the dried zinciferous surface is subsequently painted.

12. A process according to claim 11, wherein the amount of heavy metal deposited on the zinciferous surface is from 0.3 to 20 mg/m$^2$, and the dried zinciferous surface is subsequently subjected to an anticorrosion chromate treatment.

13. A process according to claim 12, wherein the zinciferous surface is that of zinciferous metal plated steel sheet.

14. A process comprising steps of contacting a zinciferous surface with a composition according to claim 2 for a time sufficient to deposit on the zinciferous surface at least 0.3 mg of heavy metal per square meter of zinciferous surface contacted, removing the zinciferous surface from contact with the aqueous composition according to claim 2, washing the coating of heavy metal on the zinciferous surface with water, and drying the zinciferous surface.

15. A process according to claim 14, wherein the amount of heavy metal deposited on the zinciferous surface is from 1 to 100 mg/m$^2$ and the dried zinciferous surface is subsequently painted.

16. A process according to claim 15, wherein the amount of heavy metal deposited on the zinciferous surface is from 0.3 to 20 mg/m$^2$ and the dried zinciferous surface is subsequently subjected to an anticorrosion chromate treatment.

17. A process according to claim 16, wherein the zinciferous surface is that of zinciferous metal plated steel sheet.

18. A process comprising steps of contacting a zinciferous surface with a composition according to claim 1 for a time sufficient to deposit on the zinciferous surface at least 0.3 mg of heavy metal per square meter of zinciferous surface contacted, removing the zinciferous surface from contact with the aqueous composition according to claim 1, washing the coating of heavy metal on the zinciferous surface with water, and drying the zinciferous surface.

19. A process according to claim 18, wherein the amount of heavy metal deposited on the zinciferous surface is tom 1 to 100 mg/m$^2$ and the dried zinciferous surface is subsequently painted.

20. A process according to claim 19, wherein the amount of heavy metal deposited on the zinciferous surface is from 0.3 to 20 mg/m$^2$, the dried zinciferous surface is subsequently subjected to an anticorrosion chromate treatment, and the zinciferous surface is that of zinciferous metal plated steel sheet.

* * * * *